United States Patent [19]

Gherardi

[11] Patent Number: 4,593,589

[45] Date of Patent: Jun. 10, 1986

[54] WEB CUTTING DEVICE

[75] Inventor: Gianluigi Gherardi, Medicina, Italy

[73] Assignee: Sasib S.p.A., Bologna, Italy

[21] Appl. No.: 473,624

[22] Filed: Mar. 9, 1983

[30] Foreign Application Priority Data

Mar. 23, 1982 [IT] Italy ..... 12481 A/82

[51] Int. Cl.[4] ..... B26D 1/20; B26D 7/08

[52] U.S. Cl. ..... 83/168; 83/338; 83/310; 83/455; 83/487

[58] Field of Search ..... 83/338, 336, 168, 374, 83/310, 330, 487, 455, 484

[56] References Cited

U.S. PATENT DOCUMENTS

| | | | |
|---|---|---|---|
| Re. 30,598 | 5/1981 | Spencer | 83/14 |
| 417,093 | 12/1889 | Robison | 83/168 X |
| 627,462 | 6/1899 | Legg | 83/310 |
| 1,421,969 | 7/1922 | Loeb | 83/338 |
| 1,510,729 | 10/1924 | Weisner | 83/310 |
| 2,674,310 | 4/1954 | Thornley . | |
| 2,916,956 | 12/1959 | Salomon | 83/338 X |
| 4,063,494 | 12/1977 | Hall | 93/77 |
| 4,090,424 | 5/1978 | Hall | 83/330 |
| 4,448,101 | 5/1984 | Templeton | 83/374 |

FOREIGN PATENT DOCUMENTS

| | | | |
|---|---|---|---|
| 800899 | 9/1958 | United Kingdom | 83/338 |

*Primary Examiner*—Donald R. Schran

*Attorney, Agent, or Firm*—Spencer & Frank

[57] ABSTRACT

This invention relates to a cutting device for severing a continuous web into a plurality of individual segments, particularly into bands for connection of filters to cigarettes, by supporting the end portion of the web on a rotating supporting drum and by cutting the segments from the end of the web on the supporting drum by means of a web-cutting blade that is cyclically moved on a plane which is transverse to the web and substantially parallel to the axis of the supporting drum, so as to effect a transverse progressive cut in the web from one longitudinal edge to the opposite longitudinal edge thereof. According to the invention on the supporting drum there are mounted a plurality of web-cutting blades movable parallelly to the axis of the drum, angularly equi-spaced around the circumference of the supporting drum and actuated so as to effect cyclically, at the angular position or interval on the circumference of the supporting drum, where the cut is to be performed, an extension or cutting stroke through the web from a laterally-retracted start position from one side edge of the web to at least the opposite side edge of the web, and a retraction stroke back to the start position.

23 Claims, 7 Drawing Figures

WEB CUTTING DEVICE

BACKGROUND OF THE INVENTION

This invention relates to the cutting devices for severing a continuous web into a plurality of individual successive segments. For this purpose, the web is supported on a rotating supporting drum and the segments are severed from the end of the web on said supporting drum.

The invention relates, particularly, to a cutting device of the type described above, comprising a web-cutting blade that is cyclically moved on a plane which is transverse to the web and substantially parallel to the axis of the supporting drum, so as to effect a transverse progressive cut in the web, from one longitudinal edge of the web to the opposite longitudinal edge thereof.

The cutting devices of this type are the subject matter of the Italian patent application 12434 A/82 of the same applicant and are used, for example, in the manufacture of filter-tipped cigarettes according to the assembling process, in order to obtain the bands or strips for connecting a filter to a cigarette from a web of covering material, for example a web of "cork-paper".

In the embodiment illustrated in the above patent application, the web-cutting blade, formed by either a stationary blade or a rotating circular blade, is mounted at the end of a blade-carrying arm rotating on a shaft which is substantially parallel to an imaginary plane which is tangent to the supporting drum at the cutting area and lies on an imaginary plane which is substantially perpendicular to the axis of said supporting arm.

SUMMARY OF THE INVENTION

According to the present invention, a plurality of web-cutting blades movable parallelly to the axis of the supporting drum, are mounted on the said drum and are arranged angularly equispaced along the circumference of the said drum, while they are actuated so as to effect cyclically, at the angular position or interval on the circumference of the supporting drum, where the cut is to be performed, an extension or cutting stroke through the web from a laterally retracted start position from one side edge of the web to, at least, the opposite side edge of the web, and a retraction stroke back to the start position.

During the retraction stroke, the web-cutting blades could travel again adjacent the lines of the cut effected during the extension or cutting stroke. However, in order to avoid this repeated travel adjacent to the same lines, and resulting possibility of slight displacement of the just-made cut, the invention provides, preferably, means to lift and disengage the web-cutting blades from said web during the retraction stroke thereof.

Each segment can be severed from the end of the web by means of a single reciprocatory web-cutting blade. The circular series of web-cutting blades is then formed by a plurality of individual reciprocatory web-cutting blades moving independently from each other, and the "track" or spacing therebetween (length of the arc between the cutting lines of two successive blades) is equal to the length of each segment to be cut from the web.

According to a particularly advantageous embodiment, the reciprocatory web-cutting blades are assembled in groups of two or more blades arranged side by side and spaced from each other, simultaneously actuated with a reciprocatory cutting movement. In this preferred embodiment, the circular series of web-cutting blades is formed by a plurality of blade assemblies, each blade assembly comprising, at least, two spaced side-by-side simultaneously moving blades, and the "track" of the blades of each assembly (i.e., the length of the arc between the cutting lines of the blades of each assembly) and the spacing between two successive blade assemblies (i.e., the length of the arc between the cutting line of the last blade of an assembly and the first blade of the next assembly) are equal to the length of each segment to be cut from the web. In this embodiment, upon each cutting stroke, for example of a pair of blades, two successive segments are simultaneously cut from the end of the web, thus simplyfying the construction of the cutting device with respect to the embodiment comprising single web-cutting blades.

The web-cutting blades of the device according to the invention may either comprise straight or curved knife-blades or, preferably, circular rotatable blades.

According to a further characteristic of the invention, means are provided to press the web-cutting blades resiliently against the side surface shell of the drum, preferably against a hard striking surface.

BRIEF DESCRIPTION OF THE DRAWINGS

These and other characteristics of the invention will be apparent from the following description of some preferred embodiments thereof, shown by way of non-limitating examples in the accompanying drawings, wherein.

DESCRIPTION OF THE PREFERRED EMBODIMENT

Figure 1:
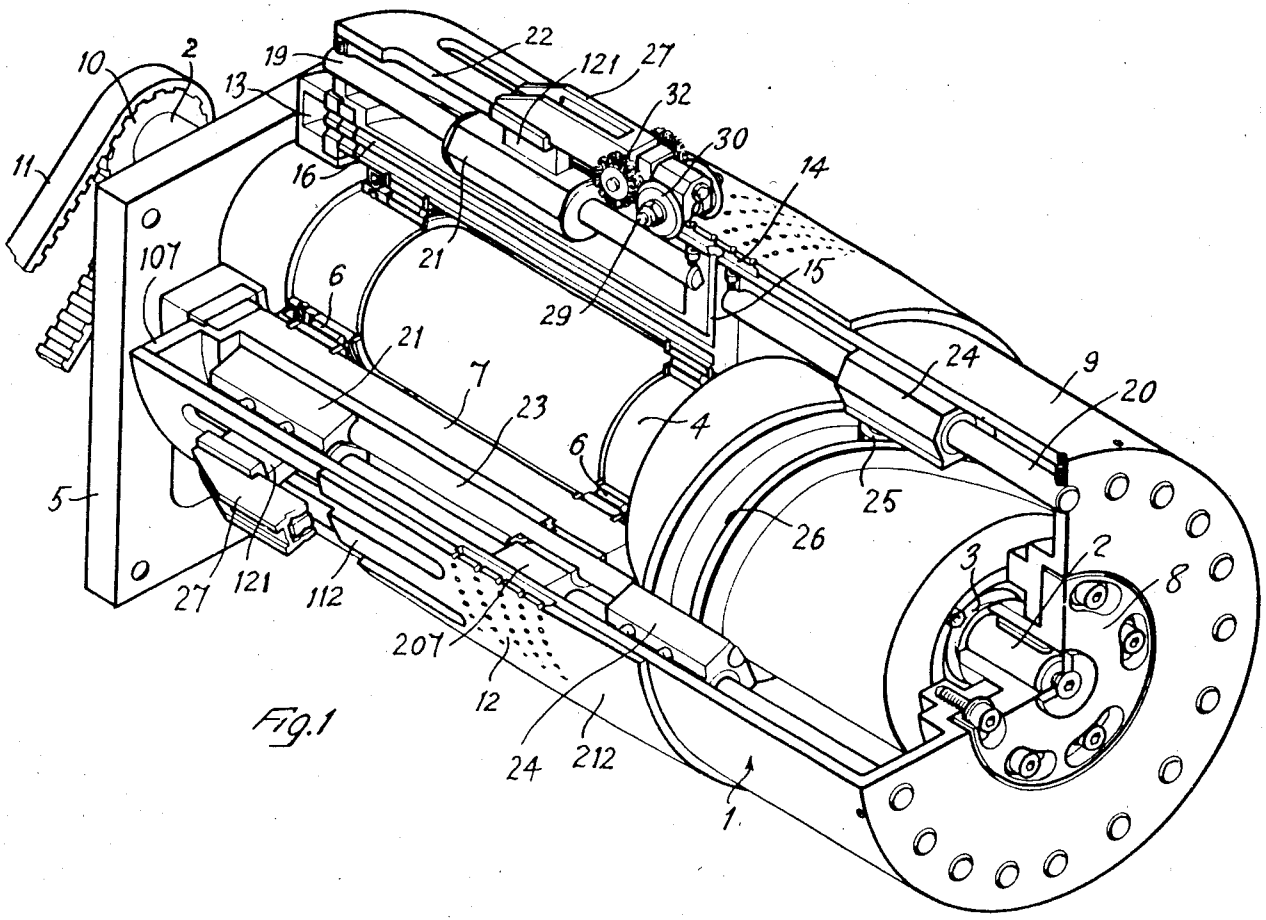
FIG. 1 is a perspective view, with some portions broken away, of a cutting device according to the invention.
Figure 2:
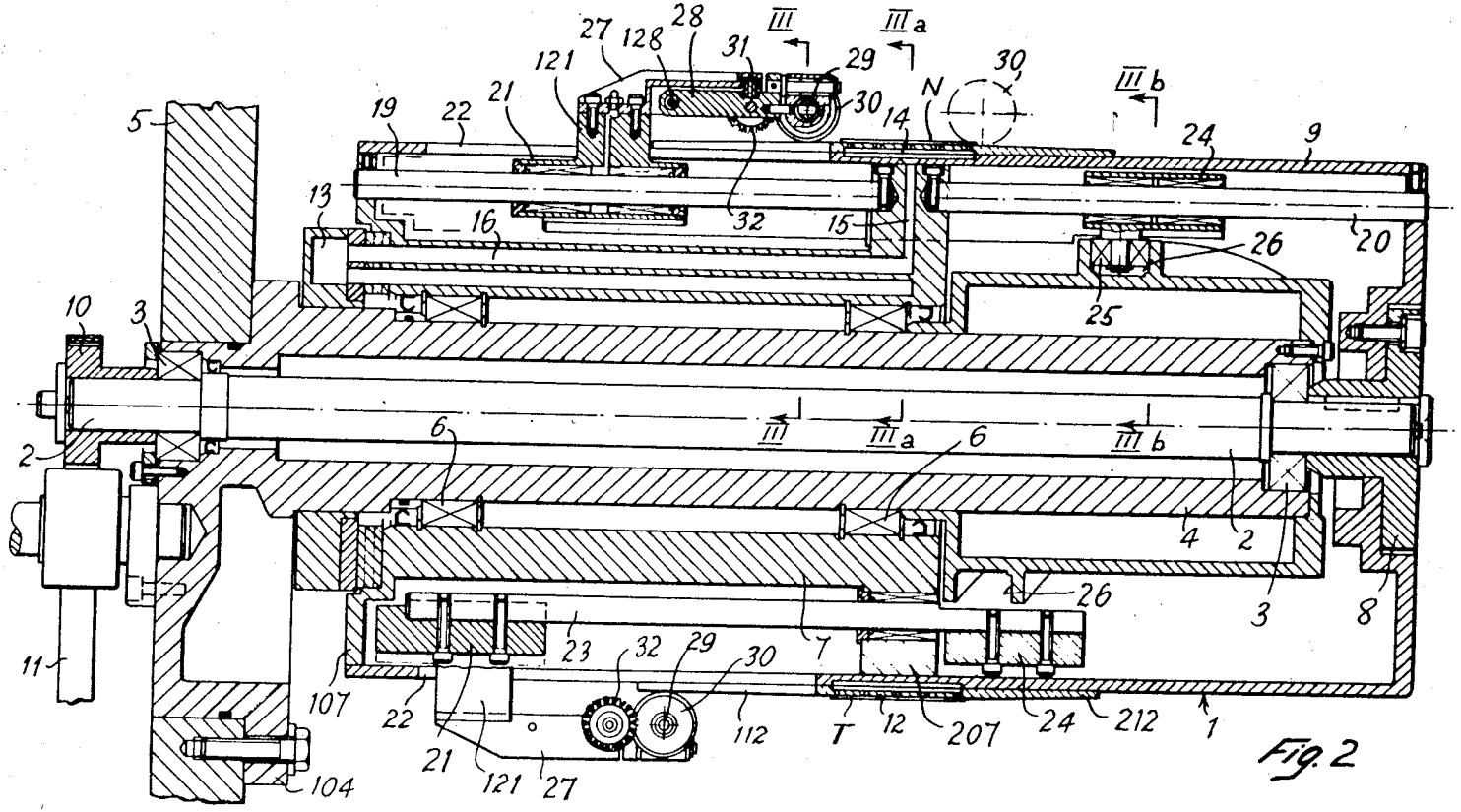
FIG. 2 is a longitudinal sectional view thereof.
Figure 3:
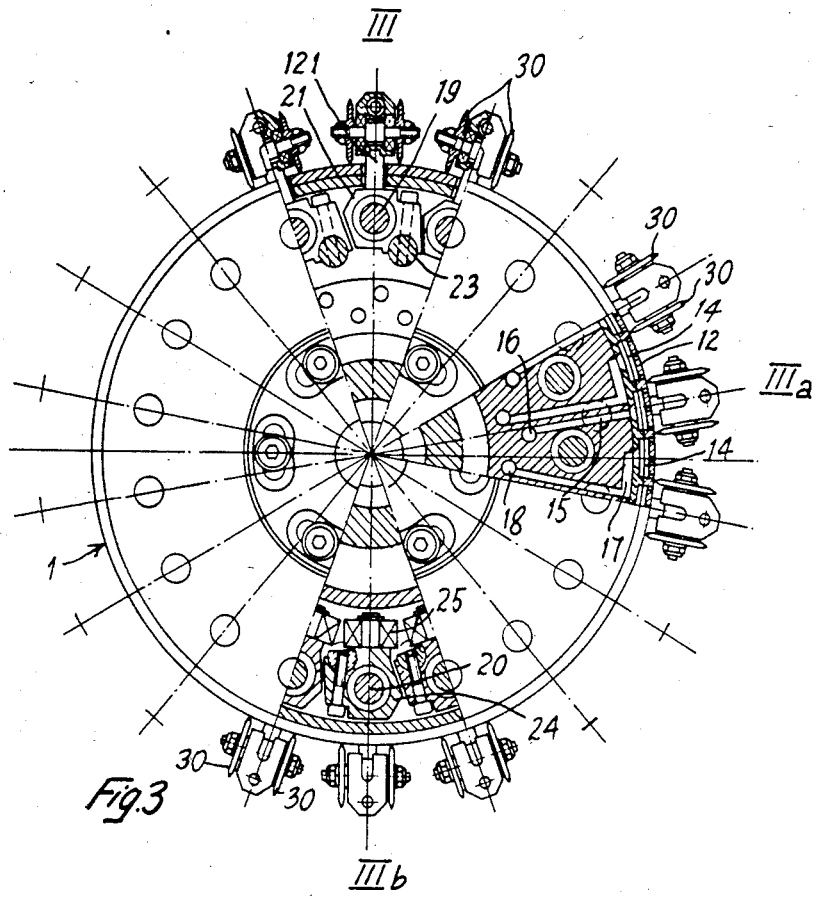
FIG. 3 is a cross-sectional view comprising a plurality of sectors as seen on the section planes III—III, IIIa—IIIa and IIIb—IIIb of FIG. 2.

With reference to FIGS. 1 to 3, the numeral 1 indicates a supporting drum, the so-called band-supporting drum, of the device according to the invention, designed, for example, to sever a web N of covering material, such as "cork-paper" or the like, by means of transverse cuts, to obtain bands T having the same length and usable in the manufacture of filter-tipped cigarettes to connect a filter to a cigarette by enwrapping together the filter and the adjacent end portion of the cigarette. The web N is fed to, and retained on, the supporting drum 1, and the just-cut bands T are first retained on, and then removed from, said supporting drum 1 in a conventional manner, for example as illustrated in the Italian patent application 12434 A/82 (excepted the mutual spacing between the bands) and, therefore, only the cutting means will be described hereinafter.

The shaft 2 of the supporting drum 1 is rotatably mounted, through the bearings 3, in a co-axial sleeve 4 fixed, through a flange 104, to the frame 5 of the machine. A sleeve 7 provided with end flanges 107, 207 is rotatably mounted, through bearings 6, on a portion of the sleeve 4, e.g. the portion nearest to the frame 5. A front disc 8 is fixed to the end portion of the shaft 2 protruding from the free end of the sleeve 4. The shell 9 of the supporting drum 1 is fixed to said front disc 8 of the shaft 2 and to the flanges 107, 207 of the sleeve 7. The other end portion of the shaft 2 is connected to any suitable actuating means; for example, it is provided with a toothed wheel 10 driven by a toothed belt 11.

Secured to the outer surface of the shell 9 of the supporting drum 1 is an annular insert bushing 12 which is of cylindrical shape at its intermediate region and is slightly tapered at its end region 112, 212. The web N to be cut is fed to, and is severed at, the intermediate region of the bushing 12, to obtain said bands T. The web N and the bands T are retained on the supporting drum 1 by suction, as known in the art. For this purpose, the intermediate region of the outer bushing 12 is provided with a plurality of suction holes communicating with a vacuum distributor 13 through peripheral sector-shaped chambers 14 and ducts 15, 16 and 17, 18 in the sleeve 7 and flange 207 thereof, as shown in detail in the sector IIIa in FIG 3.

Fixed within the supporting drum 1, between the two flanges 107, 207 of the sleeve 7, are guide rods 19 which are parallel to the axis of rotation of the drum 1 and angularly equi-spaced from each other. Co-axial with the guide rods 19 (the longitudinal axes of which are on a same cylindrical imaginary surface) are guide rods 20 fixed between the flange 207 of said sleeve 7 and the front disc 8 of said shaft 2.

A cutting carriage 21 with a radial extension 121 slidably protruding outwardly through a longitudinal slot 22 in the shell 9 of the supporting drum 1, is slidably mounted on each guide rod 19. Each cutting carriage 21 is secured to a bar 23 which extends parallelly to the shaft 2 and slidably through the flange 207 of the sleeve 7 and which is connected to an actuating carriage 24 slidably mounted mounted on an associated guide rod 20. A small roller 25 is rotatably mounted on this actuating carriage 24 and is engaged in a grooved cam 26 fixed to the stationary sleeve 4. The cam 26 is so designed as to cause—during the rotation of the supporting drum 1, when the shaft 2 causes the rotation of the shell 9 and sleeve 7 through the front disc 8—the actuating carriage 25 to effect a reciprocating stroke along the guide rod 20 upon each revolution of the cam, thereby causing a similar reciprocating stroke of the cutting carriage 21 through said bar 23.

Fixed to the radial extension 121 of each cutting carriage 21 is a bracket-shaped arm 27 extending axially, at a certain radial distance from the shell 9 of the supporting drum 1, towards the outer bushing 12. Pivoted at 128 to the arm 27 is a blade-carrying lever 28 carrying at the free end thereof, on a common spindle 29, a pair of circular blades 30. The spindles 29 of the pairs of circular blades 30 are disposed in a direction tangential to the supporting drum 1 and parallel to the pivots 128 of the blade-carrying levers 28. The distance between the cutting edges of the two circular blades 30 of each pair of blades mounted on the spindle 29 of each cutting carriage 21 is the same as the length of a band T to be severed from the web N. The distance between the cutting edge of a circular blade 30 of each pair of blades and the cutting edge of the nearest blade 30 of the pair of blades on the adjacent preceding or successive cutting carriage 21, is also the same as the length of a band T to be severed from the web N.

Thus, mounted on the supporting drum 1 is a circumferential series of circular web-cutting blades 30, angularly equi-spaced from each other with a spacing corresponding to the length of a band T and assembled in pairs, each pair of circular web-cutting blades 30 being mounted on a respective carriage that, upon each revolution of the supporting drum 1, is automatically caused to effect a reciprocating axial stroke by the action of the grooved stationary cam 26, actuating carriage 24 and connecting bar 23.

Each pair of circular web-cutting blades 30 is resiliently urged in a radial direction toward the shell 9 of the supporting drum 1. To this end, in the embodiment of the FIGS. 1 to 3, arranged between the arm 27 and blade-carrying lever 28 is, at least, a spring 31, or any other similarly resilient member, urging the blade-carrying lever 28 toward the drum 1 and depressing the respective pair of web-cutting blades 30 against the annular bushing 12 secured on the shell 9 of the supporting drum 1.

Associated with each pair of circular blades 30 is a pair of circular brushes 32, rotatably mounted on the respective blade-carrying lever 28 and designed to maintain the circular blades 30 free from any glue of which the web to be cut is coated. In the embodiment shown in the FIGS. 1 to 3, the circular brushes 32 are rotatable freely and engage the respective circuit web-carrying blades 30, which are frictionally rotated in the respective guideways of the bushing 12 during the travel of the cutting carriage 21, so as to be frictionally rotated by said circular blades 30.

The circular brushes 32 may be rotated by any other suitable means, for example by connecting them to the respective web-cutting blades 30 through suitable drive means, such as a belt drive means. Moreover, the circular blades 30 may be cleaned, rather than by said brushes 32 or in addition thereto, by suitable cleaning inserts made of any suitable material and arranged in that tapered portion 112 of the annular insert bushing 12 which is located on the same side as the cutting carriages 21. The annular bushing 12 secured on the periphery of the shell 9 of said supporting drum 1, or at least its tapered end portion 112 facing the circular series of cutting carriages 21, may be made of a softer material, so as to minimize the wear of the circular blade 30 which are resiliently urged against said annular peripheral bushing 12.

The reciprocating movement imparted by the stationary cam 26 to each cutting carriage 21 occurs at the angular sector, or or internal on the circumference, of the supporting drum 1 where the successive bands T are to be severed from the end of the web N which is supported and held by suction on the drum 1. Upon this reciprocating movement, each cutting carriage 21 is moved from a retracted rest position, axially remote from the central portion of the annular bushing 12 (shown with full lines in the lower half of FIG. 2), toward and beyond the intermediate portion of said annular bushing 12 and backwards. The pair of web-cutting blades 30 mounted on the cutting carriage 21 is correspondingly moved from the retracted rest position toward and beyond the intermediate portion of the annular bushing 12 to a final position, which is substantially on the opposite tapered portion 212 of the annular bushing 12 as is approximately shown with a dotted circumference in the upper half of FIG. 2. The pair of web-cutting blades 30 is then retracted to the initial position. During the extension stroke of this reciprocating movement of the pair of circular blades 30, two successive bands T are severed from the end portion of the web N, supported and retained by suction on the intermediate portion of the peripheral bushing 12. The severance of these two successive bands T from the web N is effected along two transverse parallel lines by a cutting action beginning from one longitudinal edge of the web N, for example the left edge of the web in FIG. 2, and continuing over the whole width of the web to opposite edge thereof, for example the right edge in FIG. 2. During the immediately following retraction stroke of the pair of circular blades 30, the latter will travel again along the two just-formed cutting lines. During both the extension or cutting stroke and the retraction stroke, the pairs of circular web-cutting blades 30 travel automatically with the web because they are mounted on the same supporting drum as the web N and, therefore, rotate therewith.

Figure 4:
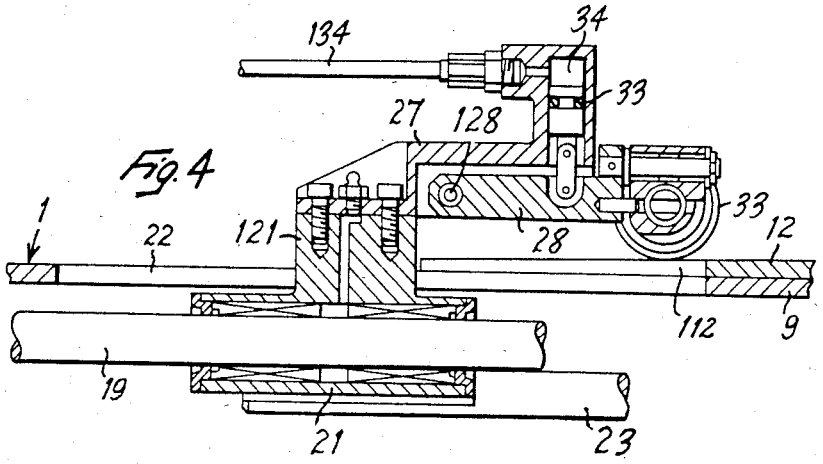
FIG. 4 is a longitudinal sectional view of a detail of a modification.

FIG. 4 is a longitudinal sectional view of a cutting carriage 21 of an embodiment of cutting device according to the invention, wherein during the retraction stroke the pairs of web-cutting blades 30 will not engage again the same cutting lines just-formed during the extension stroke. In this embodiment, the blade-carrying lever 28 of each carriage 21 is urged by a return spring (not shown) in such a direction as to be lifted from the shell 9 of the supporting drum 1, and is pivotally connected to the piston 33 of a small pneumatic cylinder 34 provided on the arm 27. The cylinder 34 communicates through a flexible hose 134 with a compressed air distributor co-axial with the supporting drum, which is known to those skilled in the art and, therefore, is not shown.

During the extension or cutting stroke of the carriage 21, the distributor feeds the compressed air to the cylinder 34, whereby its piston 33 urges the blade-carrying lever 28 toward the shell 9 of the supporting drum 1 and presses the pair of blades 30 onto the peripheral bushing 12, against the action of the return spring. During the retraction stroke of the cutting carriage 21, the distributor connects the cylinder 34 with the atmosphere, whereby the return spring will lift the blade-carrying lever 28, together with the pair of blades 30, from the peripheral bushing 12. Each pair of blades 30 need be lifted just a few tenth of millimeter from the bushing 12 to prevent the blades 30 to engage the web during their retraction stroke.

The same result can be achieved by means of a return spring urging the blade-carrying lever 28 toward the shell 9 of the supporting drum, and a pneumatic cylinder 34 lifting the lever 28 from the peripheral bushing 12. In lieu of a spring and a pneumatic single-acting cylinder, the invention could provide a double-acting cylinder effecting both the depression of the web-cutting blade 30 against the peripheral bushing 12 and the lifting of the blades 30 from said bushing 12.

In order to sever the web, the circular blades 30 can cooperate in several manners with the surface supporting the web N, which is formed, in this embodiment, by the annular peripheral insert bushing 12.

In the embodiment of the FIGS. 1 to 4, the circular blades 30 are resiliently urged with their cutting edges against the tapered striking surface of the two end portions 112, 212 of the peripheral bushing 12 and against the cylindrical striking surface of the intermediate portion of the bushing 12.

Figure 5:
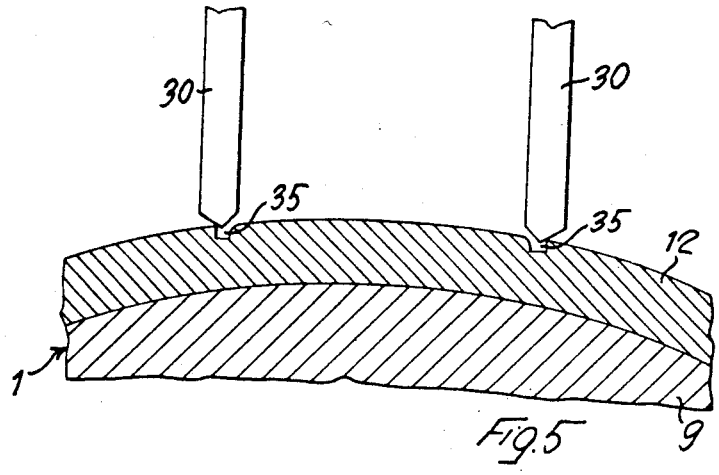
FIG. 5 is an enlarged cross-sectional view of the web-cutting blades of another modification.

In the embodiment of FIG. 5, opposite to the path of travel of the circular web-cutting blades 30, at the intermediate portion of the bushing 12, the invention provides corresponding longitudinal grooves 35. The two circular web-cutting blades 30 of the pair of blades of each cutting carriage 21 present a bi-conical edge and are pressed resiliently with the outer conical surface of their edge against the respective sharp outer corner-edges of the two corresponding grooves 35. The opposite inner corner-edges of the two grooves, on the contrary, are rounded. In this instance, the cutting action performed by the peripheral sharp edge of the circular blades 30 in the embodiment of the FIGS. 1 to 4, is performed by the sharp corner-edges of the grooves 35, while the function of striking surface performed by the surface of the peripheral bushing 12 in the embodiment of FIGS. 1 to 4, in this instance is performed by the conical edge surfaces of the circular blades 30.

Figure 6:
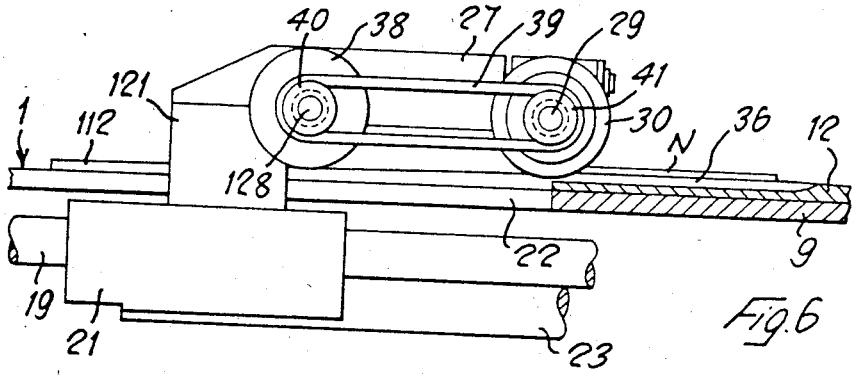
FIGS. 6 and 7 are longitudinal and cross-sectional views, respectively, of another embodiment of web-cutting blades.
Figure 7:
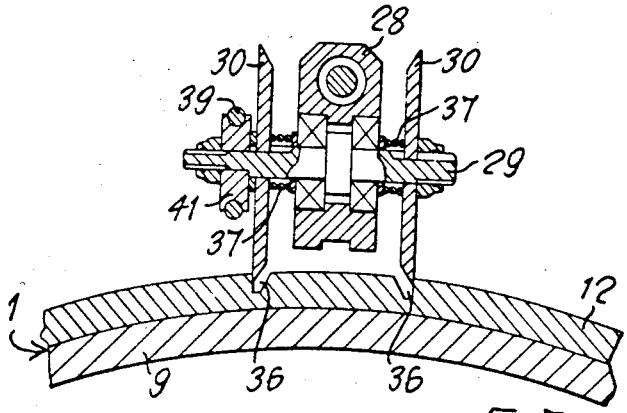

In the embodiment of the FIGS. 6 and 7, the circular blades 30 perform the cutting operation with a scissor-like cutting action, and are constructed like circular shears, i.e. they present a cutting edge which is defined at one side by a plane which is substantially perpendicular to the axis of rotation and at the opposite side by a conical surface. The two blades 30 of the pair of web-cutting blades of each cutting carriage 21 will engage corresponding longitudinal grooves 36 in the intermediate portion of the peripheral bushing 12. The outer sides of the two grooves 36 are constructed like shear counter-blades, that is they comprise a sharp edge formed by a plane which is substantially parallel to the planar side of the respective circular blade 30. The two circular blades 30 of the pair of web-cutting blades are axially slidable on the respective spindle 29 and are urged by springs 37 with the planar side thereof against the respective planar side of the outer edge of the corresponding groove 36.

The web-cutting circular blades 30 may be rotated by the frictional engagement with the peripheral bushing 12 when the cutting carriages 21 are reciprocated, as shown in FIGS. 1 to 5, or they may be rotated positively, in particular when they are constructed so as to perform a shear-like cutting action, as shown in FIGS. 6 and 7. In the embodiment according to these figures, the rotational actuation of the pair of circular blades 30 of each cutting carriage 21 is effected by means of a rubber-lined roller 38 which is freely rotatable on the same pivot 128 of the blade-carrying lever 28 and is suitably engaged with the outer surface of the peripheral bushing 12. Spring means (not shown) may also be provided, if desired, to press the rubber-lined roller 38 against the bushing 12. The rubber-lined roller 38 is connected to the spindle 29 of the two web-cutting blades 30 by any suitable drive means, for example a drive belt 39 on two pulleys 40, 41. During the reciprocating movement of each cutting carriage 21, the rubber-lined roller 38 rolls over the surface of the peripheral bushing 12 and drives the two web-cutting blades 30 into rotation.

Obviously, the invention is not limited to the embodiments herein shown and described, but changes and modifications may be broadly made thereto, particularly in the construction thereof and within the range of mechanical equivalents, without departing from the basic principle set forth above and claimed hereinafter.

What I claim is:

1. A cutting device for severing a continuous web into individual successive segments, comprising:

a rotating supporting drum on which the end portion the web is supported;

a plurality of web-cutting blades that are mounted on the drum at equi-spaced positions around the circumference thereof, said web-cutting blades being movable parallelly to the axis of the drum; and actuating means for cyclically moving said blades in a plane transverse to the web and substantially parallel to the axis of the supporting drum so as to effect a progressive transverse cut of the web from one longitudinal edge thereof to the opposite longitudinal edge thereof in order to sever successive segments from the end of the web on the supporting drum, said actuating means including means for providing, at the angular position on the supporting drum where the cut is to be effected, an extension or cutting stroke through the web from a laterally-retracted start position at one longitudinal edge to at least the opposite edge of the web, and for thereafter providing a corresponding retraction stroke to return to the start position, wherein said plurality of web-cutting blades includes a plurality of groups of at least two side-by-side blades, spaced from each other and movable simultaneously, with the spacing between the blades of each group of blades and the distance between two successive groups of blades being equal to the length of each segment to be severed from the web.

2. A device according to the preceding claim 1, characterized in that the web-cutting blades are lifted from the shell of the supporting drum upon their retraction stroke to such an extent as to prevent them from re-engaging the just-formed cutting lines.

3. A device according to the preceding claim 1, characterized in that the groups of web-cutting blades are movable independently from each other.

4. A device according to the preceding claim 1 characterized in that the web-cutting blades are rotatable circular blades.

5. A device according to the preceding claim 1, characterized in that each group of at least two blades is mounted on a blade-carrying lever which is pivotable substantially radially of the supporting drum and is pivoted on the bracket-shaped arm of a cutting carriage which is axially slidably mounted in the supporting drum and is coupled to actuating means whereby it is reciprocated with an extension and a retraction stroke at an angular position or the supporting drum where the cut is to be performed.

6. A device according to claim 5, characterized in that said blade-carrying levers are acted upon by spring means urging the respective blades toward the shell of the drum.

7. A device according to claim 5, characterized in that said blade-carrying levers are acted upon by hydraulic, penumatic, or electrical means adapted to lift the respective blades from the shell of the drum and/or to urge them toward the shell of the drum, if desired, against the action of resilient return means.

8. A device according to claim 5, characterized in that the actuating means for the cutting carriages comprises a stationary cylindrical grooved cam wherein each cutting carriage is engaged by means of a roller or the like.

9. A device according to the preceding claim 1, characterized by means, such as brush means, for cleaning the web-cutting blades, wherein said means may be either fixed on the shell of the drum at the path of travel of the respective blades and/or movable with the respective blades.

10. A device according to claim 1, characterized in that, the web-cutting blades are circular and, during at least said cutting stroke, are pressed radially with their cutting edges against corresponding striking surfaces provided on the shell of the supporting drum.

11. A device according to the preceding claim 1, characterized in that web-cutting blades are circular and in that, upon at least the cutting step, the circular web-cutting blades are pressed radially with a conical surface of their peripheral edge against the sharp cutting corner-edge of a corresponding longitudinal groove provided in the shell of the supporting drum.

12. A device according to the preceding claim 1, characterized in that web-cutting blades are circular and in that, upon at least the cutting step, the circular web-cutting blades will engage into respective longitudinal grooves provided in the shell of the supporting drum and are pressed axially with a planar side thereof against the inner planar side thereof of the sharp cutting corner-edge of the respective groove, so as to perform a scissor-like cutting action.

13. A device to according the preceding claim 4, characterized in that the circular web-cutting blades are rotated by their rolling engagement with the shell of the supporting drum.

14. A device according to claim 12 characterized in that the circular web-cutting blades are rotated positively.

15. A device according to claim 14, characterized in that each circular web-cutting blade or each group of circular web-cutting blades has associated therewith at least an actuating roller which rolls on the shell of the supporting drum upon the reciprocating movement of the respective blade or blades and is operatively coupled to said blade or blades so as to cause the rotation thereof.

16. A device according to the preceding claim 1, characterized in that the shell of the supporting drum is provided with an outer annular insert bushing cooperating with said web-cutting blades and presenting a central cylindrical portion which is preferably provided with suction holes and whereon said web is supported and severed, and two side portions which are slightly tapering towards their respective ends.

17. A cutting device for severing individual segments from the end of an elongated web having a pair of longitudinal edges, the end of the web being supported on the periphery of a rotating drum having first and second ends and an axis running through said ends, with the longitudinal edges of the web being disposed in planes perpendicular to the axis of the drum, comprising:

a plurality of web-cutting blades;

mounting means for movably mounting said blades to said drum at equally spaced positions about said periphery thereof, said blades being movable parallel to said axis of said drum; and actuating means connected to said mounting means for cyclically reciprocating said blades so as to cut said individual segments from said web, said actuating means including means for moving at least one of said blades toward said first end of said drum while at least one other of said blade is moving toward said second end of said drum;

wherein said mounting means includes a plurality of guide rods having axes, means for fixedly mounting said guide rods to said drum at equally spaced positions with said axes of said guide rods parallel to said axis of said drum, a plurality of cutter carriages, each cutter carriage being slidably mounted on a respective one of said guide rods, and a plurality of blade-holding means, each corresponding to a respective cutter carriage, for mounting at least one of said blades to a respective cutter carriage.

wherein said actuating means comprises means fixedly mounted with respect to said drum for providing a cam groove, and, for each respective cutter carriage, a linkage means engaging said cam groove for operatively connecting the respective cutter carriage to the guide groove, each linkage means engaging said cam groove at a different position therealong, and wherein each blade-holding means comprises means for mounting a group of spaced apart blades, the spacing between adjacent blades in each group being equal to the length of each segment to be severed from said web, the spacing between the closest blades in adjacent groups additionally being equal to the length of each segment to be severed from said web.

18. The cutting device of claim 17, wherein said actuating means is disposed within said drum.

19. The cutting device of claim 17, wherein said blades are circular, and wherein said blades are rotatably mounted by said blade-holding means.

20. The cutting device of claim 17, wherein each blade-holding means further comprises means for biassing the group of blades mounted thereby toward said drum both as the group moves toward said first end of said drum and as the group moves toward said second end of said drum.

21. The cutting device of claim 17, wherein each blade-holding means further comprises means for biassing the group of blades thereby mounted toward said drum as the group moves toward said first end of said drum and spacing the group away from said drum as the group moves toward the second end of said drum.

22. The cutting device of claim 17, wherein said drum has elongated grooves on the periphery thereof, said grooves being parallel to the axis of said drum, and wherein said blade-holding means comprises means for biassing each blade of the group thereby mounted into a respective groove.

23. The cutting device of claim 17, wherein each blade-holding means further comprises a roller disposed against said drum and means operatively connected to said roller for rotating the blades of the group mounted by the blade-holding means.

* * * * *